US010239717B2

(12) United States Patent
Kai et al.

(10) Patent No.: US 10,239,717 B2
(45) Date of Patent: Mar. 26, 2019

(54) IMAGE FORMING APPARATUS, IMAGE FORMING METHOD, AND SHEET-FEEDING APPARATUS

(71) Applicant: CANON KABUSHIKI KAISHA, Tokyo (JP)

(72) Inventors: Teruhito Kai, Kashiwa (JP); Shinnosuke Iwadate, Toride (JP); Hiroto Nishihara, Tsukuba (JP); Hiromi Shimura, Toride (JP); Keita Takahashi, Abiko (JP); Kentaro Tamura, Komae (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/224,924

(22) Filed: Aug. 1, 2016

(65) Prior Publication Data

US 2017/0066610 A1 Mar. 9, 2017

(30) Foreign Application Priority Data

Sep. 4, 2015 (JP) ..... 2015-174950

(51) Int. Cl.

| | |
|---|---|
| ***B65H 7/02*** | (2006.01) |
| ***B65H 3/06*** | (2006.01) |
| ***B65H 5/06*** | (2006.01) |
| ***G03G 15/00*** | (2006.01) |

(52) U.S. Cl.

CPC ..... *B65H 7/02* (2013.01); *B65H 3/0684* (2013.01); *B65H 5/062* (2013.01); *G03G 15/6514* (2013.01); *B65H 2511/11* (2013.01); *B65H 2801/03* (2013.01); *G03G 15/5016* (2013.01); *G03G 15/6552* (2013.01)

(58) Field of Classification Search

CPC . B65H 7/02; B65H 7/04; B65H 5/062; B65H 3/0684; B65H 2511/10; G03G 15/6514

See application file for complete search history.

(56) References Cited

U.S. PATENT DOCUMENTS

| | | | | |
|---|---|---|---|---|
| 4,796,035 | A | 1/1989 | Kawasaki et al. | |
| 5,290,024 | A | 3/1994 | Takahashi | |
| 5,474,287 | A | 12/1995 | Takahashi | |
| 5,666,595 | A | 9/1997 | Sameshima et al. | |
| 5,689,759 | A * | 11/1997 | Isemura | G03G 15/6514 271/171 |
| 5,909,872 | A | 6/1999 | Takahashi | |
| 6,311,039 | B1 | 10/2001 | Funamizu et al. | |

(Continued)

FOREIGN PATENT DOCUMENTS

| | | | | |
|---|---|---|---|---|
| JP | 07-097079 | A | 11/1995 | |
| JP | 2015139931 | A * | 8/2015 | B65H 7/06 |

*Primary Examiner* — Patrick Cicchino

(74) *Attorney, Agent, or Firm* — Venable LLP

(57) ABSTRACT

Provided is an image forming apparatus including a manual feed tray for placing a sheet subjected to image formation, a sheet sensor configured to detect whether or not the sheet is placed on this manual feed tray, a pickup roller configured to feed the sheet placed on the manual feed tray, and a controller. When a size of a sheet to be fed is designated by a user, and it is determined that the sheet is placed, the controller causes at least one of the pickup roller and the manual feed tray to start movement to a position of enabling the pickup roller to feed the placed sheet.

12 Claims, 10 Drawing Sheets

(56) References Cited

U.S. PATENT DOCUMENTS

| | | | | |
|---|---|---|---|---|
| 6,397,035 | B2 | 5/2002 | Kataoka et al. | |
| 6,651,980 | B2 | 11/2003 | Isemura et al. | |
| 6,793,425 | B2 | 9/2004 | Yoshikawa et al. | |
| 8,180,234 | B2 | 5/2012 | Takahashi et al. | |
| 8,632,070 | B2 * | 1/2014 | Nonaka | B41J 11/003 271/265.01 |
| 8,840,101 | B2 * | 9/2014 | Yamada | B65H 9/00 271/2 |
| 9,150,376 | B2 * | 10/2015 | Takahashi | B65H 85/00 |
| 9,499,366 | B2 * | 11/2016 | Morikami | B65H 7/02 |
| 2012/0187622 | A1 * | 7/2012 | Kamichi | B65H 1/04 271/171 |
| 2016/0012320 | A1 * | 1/2016 | Takahashi | B65H 1/04 358/1.15 |
| 2016/0101954 | A1 * | 4/2016 | Takahashi | H04N 1/00482 271/265.03 |
| 2016/0342124 | A1 * | 11/2016 | Iwadate | G03G 15/6508 |

* cited by examiner

| SIZE | MAIN SCANNING LENGTH | SUB-SCANNING LENGTH | MANUALLY FED SHEET PRESENCE /ABSENCE SENSOR | FIRST SENSOR | SECOND SENSOR | SHEET WIDTH SENSOR |
|---|---|---|---|---|---|---|
| A5 | 210 | 148 | ON | OFF | OFF | 0X320 ± 0X010 |
| B5 | 257 | 182 | ON | OFF | OFF | 0X384 ± 0X010 |
| A4 | 297 | 210 | ON | OFF | OFF | 0X3D4 ± 0X010 |
| A5R | 148 | 210 | ON | OFF | OFF | 0X258 ± 0X010 |
| B5R | 182 | 257 | ON | ON | OFF | 0X2E4 ± 0X010 |
| A4R | 210 | 297 | ON | ON | OFF | 0X320 ± 0X010 |
| B4 | 257 | 364 | ON | ON | ON | 0X384 ± 0X010 |
| A3 | 297 | 420 | ON | ON | ON | 0X3D4 ± 0X010 |

FIG. 6

FIG. 8A
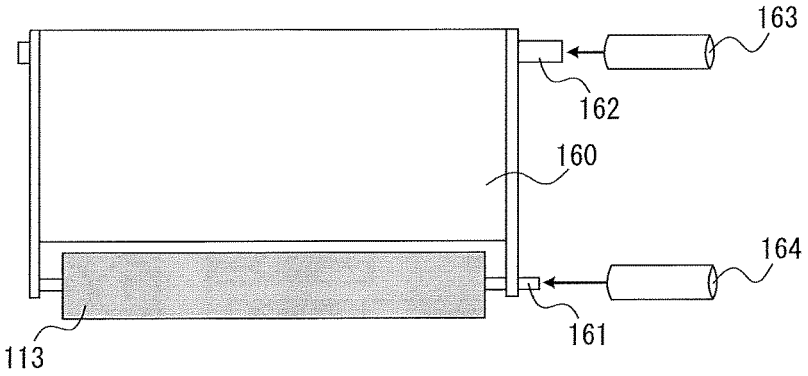
FIG. 8B
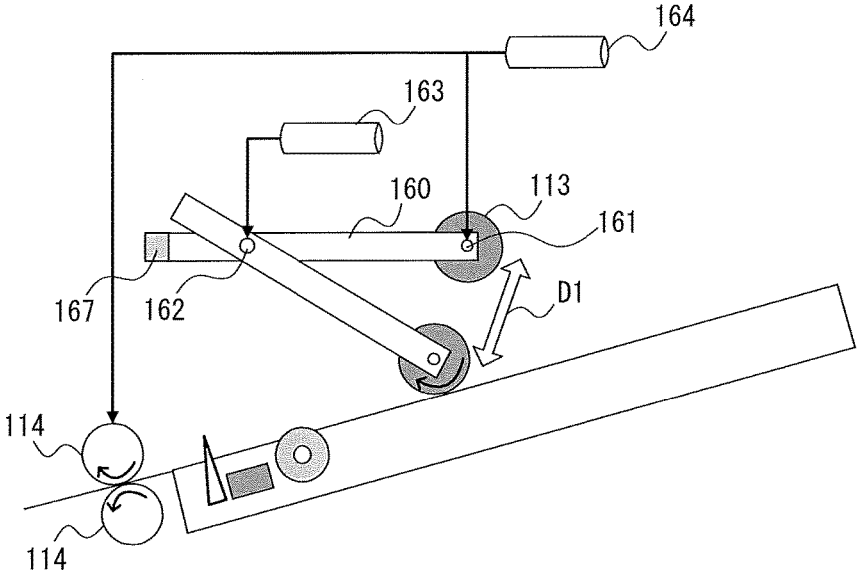
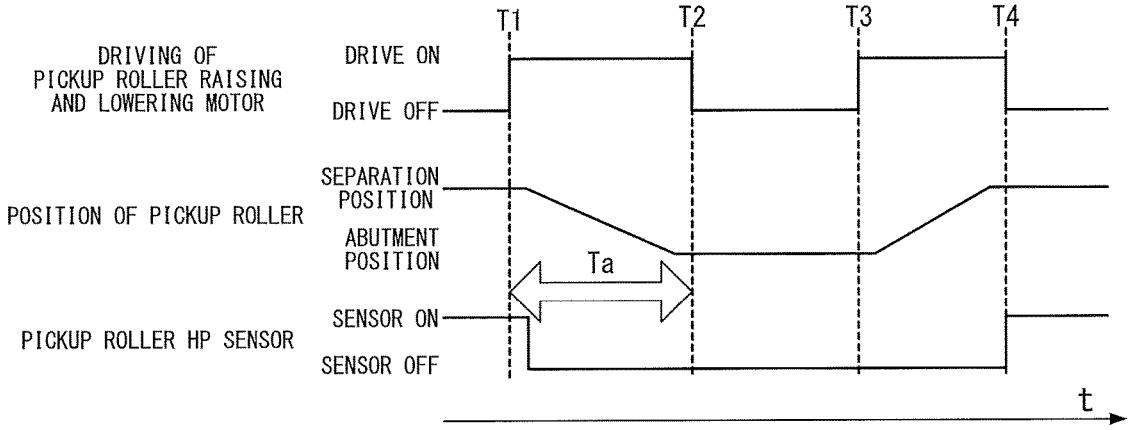
FIG. 8C

IMAGE FORMING APPARATUS, IMAGE FORMING METHOD, AND SHEET-FEEDING APPARATUS

BACKGROUND OF THE INVENTION

Field of the Invention

The present disclosure relates to an image forming apparatus, an image forming method, and a sheet-feeding apparatus. More particularly, the present disclosure relates to a sheet-feeding control for a copying machine, a printer, and the like, which are configured to perform image formation on a sheet.

Description of the Related Art

An electrophotographic image forming apparatus includes a sheet-feeding cassette and a sheet-feeding tray, e.g., a manual feed tray, and is configured to feed a sheet placed on the sheet-feeding cassette or the sheet-feeding tray to an image forming section for performing image formation. In particular, when image formation is performed on a thick sheet, a coated sheet, or another sheet having a large basis weight which cannot be handled by the sheet-feeding cassette, the manual feed tray is widely used.

In Japanese Patent Application Laid-open No. Hei 7-97079, there is disclosed a drive transmission mechanism including a pickup roller configured to feed a sheet placed on a manual feed tray and a sheet-feeding roller located downstream in a conveying direction. The pickup roller and the sheet-feeding roller are driven by the same drive power source. A support arm for the pickup roller is swung upward and downward each time the pickup roller performs sheet feeding, thereby allowing an uppermost sheet on the sheet-feeding tray to be fed to an image forming section one after another.

Further, hitherto, there has been a demand for an image forming apparatus to shorten a first copy time, which is a time period from pressing a copy key to outputting a first copy. As a matter of course, it is desired that the first copy time be shortened also in the case of sheet feeding from the manual feed tray described above.

There has been widely known a function called "fixed size mode" of setting in advance a size of a sheet to be used with the manual feed tray for the purpose of improving usability for a user who frequently uses the manual feed tray. Enabling this function can eliminate an annoying operation of performing size setting through an operation unit each time the manual feed tray is used.

However, in the related art, the pickup roller is raised each time one sheet is fed from the manual feed tray regardless of whether or not the fixed size mode is enabled. As a result, the pickup roller waits at an upper limit position, which is an initial position, when a sheet-feeding operation is not performed. When printing is started, sheet feeding is delayed by a time period of lowering the pickup roller from the upper limit position to a surface of a sheet on the manual feed tray for sheet feeding and a waiting time until vibration of the pickup roller on the sheet is ceased. This delay time may cause the first copy time to be lengthened.

SUMMARY OF THE INVENTION

An image forming apparatus according to the present disclosure comprises: a manual feed tray for placing a sheet subjected to image formation; a determining unit configured to determine whether the sheet is placed on the manual feed tray or not; a sheet-feeding unit configured to feed the sheet placed on the manual feed tray; and a controller, wherein, in a case where a size of a sheet to be fed onto the manual feed tray is designated by a user in advance and the determining unit determines that the sheet is placed, the controller causes at least one of the sheet-feeding unit and the manual feed tray to start movement so that the sheet-feeding unit and the manual feed tray approach to each other.

Further features of the present invention will become apparent from the following description of exemplary embodiments (with reference to the attached drawings).

BRIEF DESCRIPTION OF THE DRAWINGS

FIG. 6 is a data table for showing a relationship between detection results of sensors and sheet sizes.

FIG. 8A and FIG. 8B are explanatory views for illustrating raising and lowering operations of the pickup roller.

FIG. 8C is a timing chart for illustrating the raising and lowering operations of the pickup roller.

FIG. 11 is a flowchart for illustrating a control which is executed when power is turned on.

DESCRIPTION OF THE EMBODIMENTS

<Schematic Configuration of Image Forming System>

Figure 1:
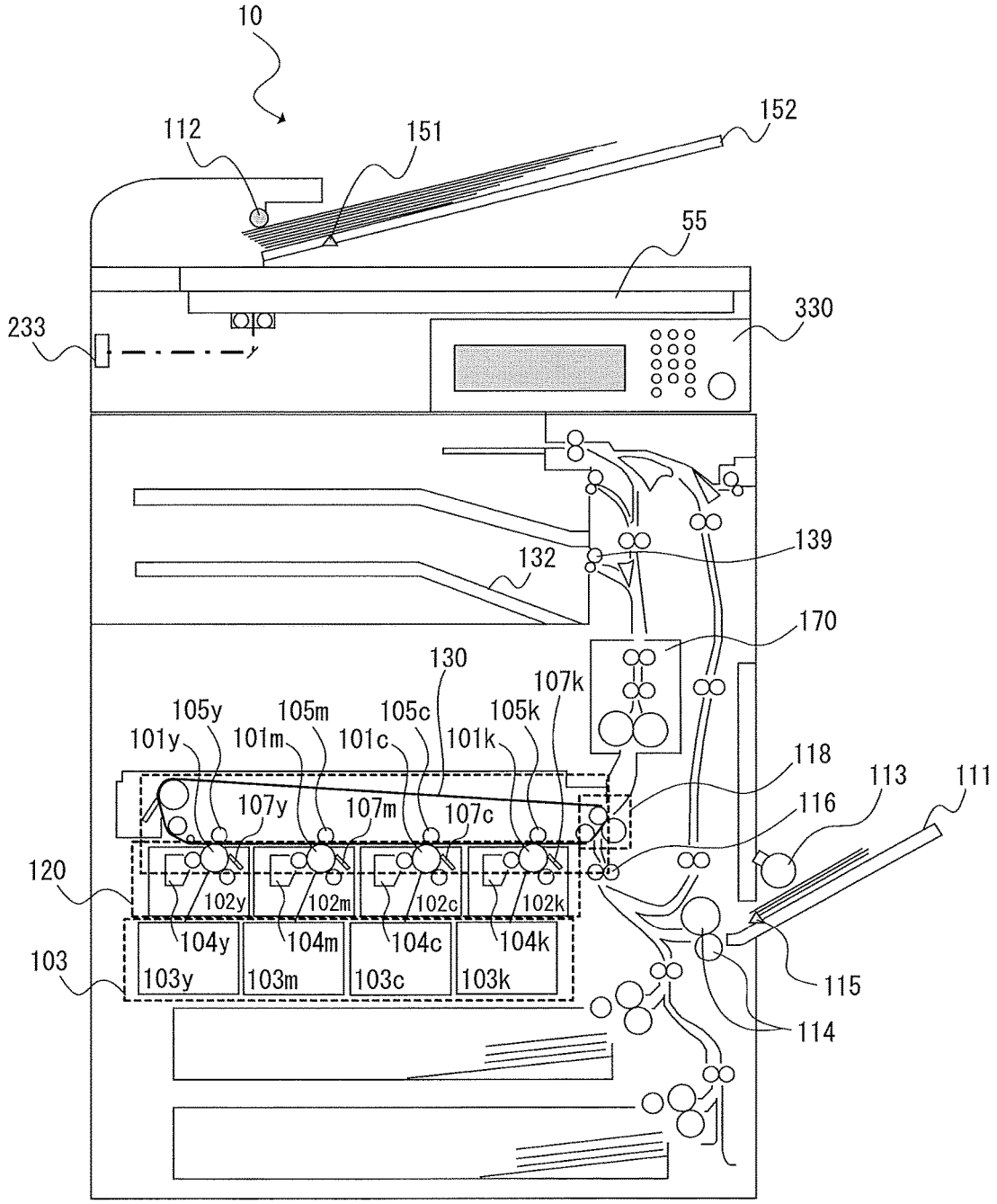
FIG. 1 is a sectional view for illustrating an image forming apparatus main body.
Figure 2:
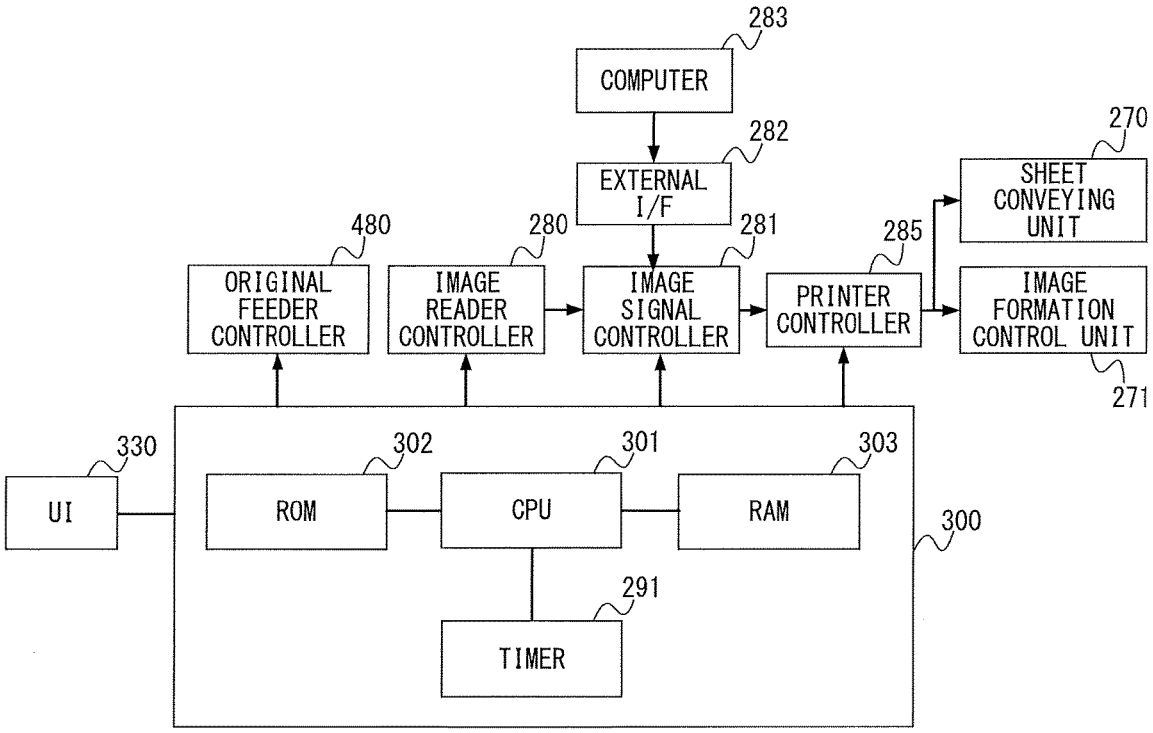
FIG. 2 is a functional block diagram of the image forming apparatus.

FIG. 1 is a sectional view for illustrating an image forming apparatus 10 according to a first embodiment of the present invention. Further, FIG. 2 is a functional block diagram of the image forming apparatus 10. Now, the first embodiment is described with reference to FIG. 1 and FIG. 2.

<Schematic Configuration of Image Forming Apparatus>

As illustrated in FIG. 1, the image forming apparatus 10 according to this embodiment can forma color image with toners of four colors, that is, a plurality of colors including yellow (y), magenta (m), cyan (c), and black (k). Further, image formation can also be performed with one color (single color) selected from among the toners of four colors. In this description, an exemplary case is described in which single color image formation is monochromatic printing (black).

Further, the image forming apparatus 10 can be connected to a computer 283 or other device (for example, a facsimile machine) through an external I/F 282 illustrated in FIG. 2.

The image forming apparatus 10 includes laser scanner units 103, primary transfer rollers 105 (y, m, c, and k) serving as transfer members, an intermediate transfer belt 130 which is one example of a transfer belt, a fixing unit 170, and a manual feed tray 111 configured to receive a sheet (e.g., a sheet). Now, an example of using a sheet as a sheet is described.

The image forming apparatus 10 further includes a pickup roller 113 configured to operate as a movable sheet-feeding unit, sheet-feeding rollers 114, a sheet sensor 115, a registration roller 116, a secondary transfer unit 118, image forming units 120, and a sheet delivery roller 139. Yet further, the image forming apparatus 10 includes a sheet delivery tray 132, an operation unit (hereinafter referred to as UI (user interface)) 330, an original holder 152, an original conveying roller 112, an original presence/absence sensor 151, an image sensor 233, and an original glass 55. The sheet sensor 115 is configured to detect whether or not a sheet is present on the manual feed tray 111.

The image forming units 120 include photosensitive drums 101 (y, m, c, and k), charging rollers 102 (y, m, c, and k), developing units 104 (y, m, c, and k), and photosensitive drum cleaners 107 (y, m, c, and k), respectively.

The controller 300 illustrated in FIG. 2 includes a CPU (Central Processing Unit) 301, a ROM (Read Only Memory) 302, a RAM (Random Access Memory) 303, and a timer 291. The CPU 301 of the controller 300 is configured to execute a control of the image forming apparatus 10. The ROM 302 storing a control program written therein and the RAM 303 configured to store variables for use in the control and image data read by the image sensor 233 are connected to the CPU 301 through an address bus and a data bus. The timer 291 capable of counting time is connected to the CPU 301. The CPU 301 is configured to set a time count value for the timer 291 and obtain a timer measurement value from the timer 291.

The CPU 301 is configured to drive the original conveying roller 112 through an original feeder controller 480 and detect presence of an original through the original presence/absence sensor 151. Further, the CPU 301 is configured to detect opening and closing operations of an original pressing plate through an image reader controller 280. Further, the CPU 301 is configured to obtain an image of an original on the original glass 55 or an image of an original fed by the original feeder controller 480 through the image sensor 233. After that, the CPU 301 transfers an analog image signal obtained from the image sensor 233 to an image signal controller 281.

During a copying operation, the image signal controller 281 executes processing which is necessary for the copying operation after converting the analog image signal from the image sensor 233 into a digital image signal, converts the processed digital image signal into a video signal, and outputs the video signal to a printer controller 285. Further, during the printing operation, the image signal controller 281 executes various necessary processing to a digital image signal input from the computer 283 through the external I/F 282, converts the digital image signal into a video signal, and outputs the video signal to the printer controller 285.

The printer controller 285 instructs image formation to the image formation control unit 271 based on an instruction from the CPU 301. The image formation control unit 271 drives the image forming units 120 in accordance with the input video signal. Further, in accordance with an instruction from the CPU 301, the image formation control unit 271 controls a sheet conveying unit 270 to feed and convey a sheet, and controls raising and lowering operations of the pickup roller 113. Further, the CPU 301 determines through the printer controller 285 whether a sheet is placed on the manual feed tray 111 of FIG. 1 or not. In this embodiment, the CPU 301 determines that a sheet is placed when the sheet is detected by the sheet sensor 115 illustrated in FIG. 1.

The UI 330 is an operation unit of the image forming apparatus 10. Through the UI 330, a user gives instructions, such as selection of a color mode in image formation, indication of a state of the image forming apparatus 10, and start of copying. When the CPU 301 detects that a sheet is set on the manual feed tray 111, the CPU 301 causes a sheet size selection screen to be displayed on the UI 330. The mode setting selected through this operation is stored in the RAM 303.

<Basic Image Forming Operation of Image Forming Apparatus>

Next, a basic image forming operation is described with reference to FIG. 1 and FIG. 2. The CPU 301 detects through the sheet sensor 115 that a sheet is set on the manual feed tray 111, and causes the sheet size selection screen to be displayed on the UI 330. When the sheet size is selected and settled by a user, the CPU 301 causes the pickup roller 113 to perform raising and lowering operations. As a result, a position of the pickup roller 113 is moved to a pickup roller abutment position where a nip portion is formed with a sheet placed on the manual feed tray 111.

The CPU 301 detects print setting instructions of a color mode, the number of prints, and other settings through the UI 330. Then, the CPU 301 detects opening and closing of the original pressing plate and placement of an original through the original feeder controller 480 and the image reader controller 280. The CPU 301 performs print preparation operation after detection of those print setting instructions, opening and closing of the original pressing plate, and placement of an original.

During the print preparation operation, the CPU 301 starts a temperature adjustment control for the fixing unit 170. When a size of a sheet on the manual feed tray 111 is settled, the CPU 301 detects whether or not the pickup roller 113 is located at a position held in abutment against a sheet (hereinafter simply referred to as "abutment position"). When the pickup roller 113 is not located at the abutment position, the position of the pickup roller 113 is moved to the abutment position. The raising and lowering operations of the pickup roller 113 and the print preparation operation are described later in detail.

Next, when the start of the printing operation is notified through the UI 330, the CPU 301 starts reading of an original through the original feeder controller 480. Further, the CPU 301 drives the original conveying roller 112 to convey an original from the original holder 152 to a position above a platen glass and radiates light of a lamp (not shown) to the original through the platen glass.

Reflected light from the original is guided to the image sensor 233, and image data of the original read by the image sensor 233 is output to the image signal controller 281. Reading of the original is continued until reading of the original on the original glass 55 is completed or until reading of the last original detected by the original presence/absence sensor 151 is completed.

The CPU 301 controls the image forming units 120 (y, m, c, and k) through the image formation control unit 271 to start image forming operation of image data stored in the RAM 303.

The image forming units 120 (y, m, c, and k) include the photosensitive drums 101 (y, m, c, and k), the developing units 104 (y, m, c, and k), the charging rollers 102 (y, m, c, and k), and the photosensitive drum cleaners 107 (y, m, c, and k), respectively. In the image forming units 120 (y, m, c, and k), surfaces of the photosensitive drums 101 are charged, and latent images are formed on the photosensitive drums 101 (y, m, c, and k) by laser beams radiated from the laser scanner units 103 (y, m, c, and k), respectively.

The formed latent images are developed on the photosensitive drums 101 by the toners in the developing units. After that, toner images developed on the photosensitive drums 101 are applied with a primary transfer voltage at a monochromatic primary transfer roller 105*k* and color primary transfer rollers 105 (y, m, and c) and transferred onto the intermediate transfer belt 130. The toner images transferred onto the intermediate transfer belt 130 reach the secondary transfer unit 118 through rotation of the intermediate transfer belt 130.

Through the sheet conveying unit 270, the CPU 301 drives, a motor (not shown) which serves as a drive source for the pickup roller 113, the sheet-feeding rollers 114, the registration roller 116, and the sheet delivery roller 139. This driving is performed so as to coincide with the timing at which the toner images arrive at the secondary transfer unit 118. As a result, the pickup roller 113 is driven to rotate, and hence sheets are fed and conveyed one after another from the manual feed tray 111.

In such a manner as described above, the secondary transfer voltage is applied to the sheet and the toner images having reached the secondary transfer unit 118, to thereby transfer the toner images to the sheet.

The sheet after the secondary transfer is conveyed to the fixing unit 170. In the fixing unit 170, the toner images on the sheet are heated and fixed on the sheet. After that, the CPU 301 performs delivery of the sheet to the sheet delivery tray 132 through the sheet delivery roller 139 controlled by the sheet conveying unit 270. After the printing operation is completed, the CPU 301 causes the pickup roller 113 to be moved upward from the position held in abutment against the manual feed tray 111 to a pickup roller separation position.

The above-mentioned basic image forming operation is one example, and the present invention is not limited to the above-mentioned configuration.

<Configuration to Detect Sheet>

Figure 3:
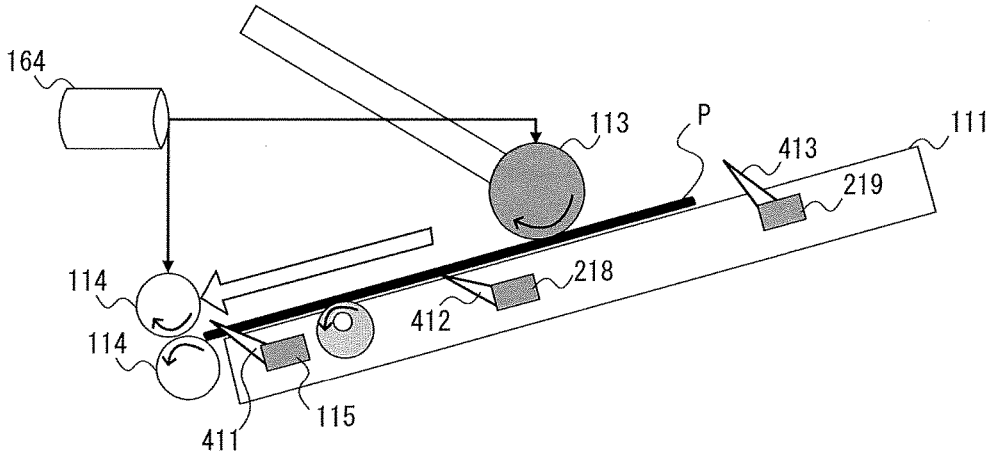
FIG. 3 is a sectional view for illustrating a manual feed tray.

With reference to FIG. 3, a configuration to detect a sheet placed on the manual feed tray 111 according to the first embodiment is described.

FIG. 3 is a sectional view for illustrating the manual feed tray 111. When a sheet P is set on the manual feed tray 111, a sheet flag 411 configured to detect presence of the sheet P is pushed and moved by the sheet P and shades the sheet sensor 115. When the sheet sensor 115 is shaded, the sheet sensor 115 detects that the sheet P is present on the manual feed tray 111. As a result, the CPU 301 can determine that the sheet P is placed on the manual feed tray 111. Further, the manual feed tray 111 includes a first detection flag 412 configured to detect a sheet length in a conveying direction of the sheet P set on the manual feed tray 111. When the sheet P is set, the sheet length can be detected based on whether or not the first sensor 218 is shaded. Similarly, a second detection flag 413 and a second sensor 219 are provided in the manual feed tray 111 to detect a sheet length.

In a case where a function to register a fixed size of a sheet to be placed on the manual feed tray (hereinafter referred to as fixed size mode), which is described later, is not enabled, when the sheet P is set on the manual feed tray 111, the CPU 301 causes the sheet size selection screen to be displayed on the UI 330. Meanwhile, in a case where the fixed size mode is enabled, even when the sheet P is set on the manual feed tray 111, the CPU 301 does not cause the sheet size selection screen to be displayed on the UI 330. Details of display on the UI 330 are described later.

Further, rotation of the sheet-feeding conveyance motor 164 under a state in which the pickup roller 113 is held in abutment against the sheet P causes the pickup roller 113 and the sheet-feeding rollers 114 to be rotated, to thereby feed and convey the sheet P in a direction indicated by the arrow.

<Detection of Size of Sheet on Manual Feed Tray>

Figure 4:
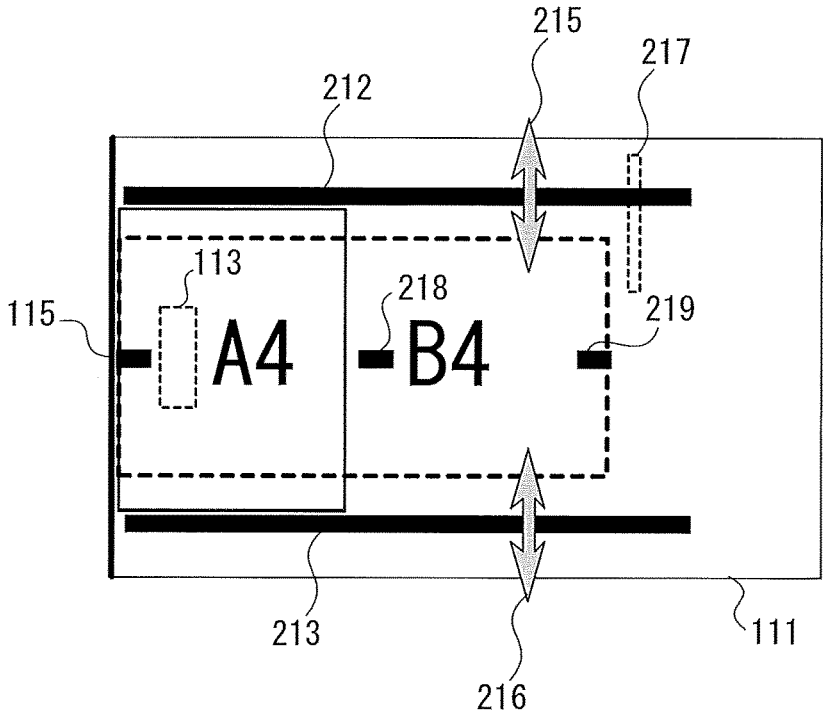
FIG. 4 is a plan view for illustrating the manual feed tray.
Figure 5:
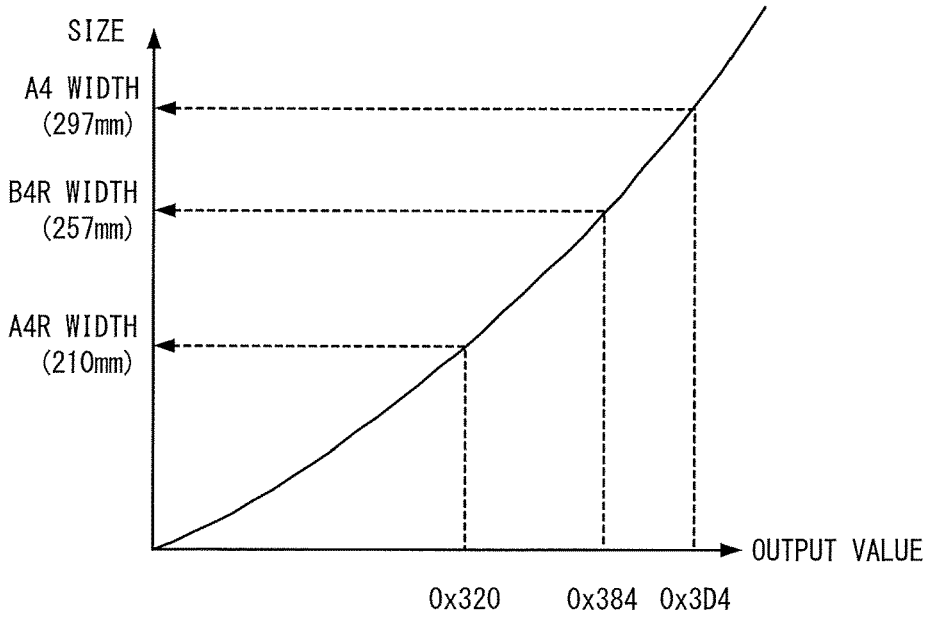
FIG. 5 is a graph for showing a relationship between a main scanning length and a sheet width sensor.

Next, with reference to FIG. 4 and FIG. 5, a method of determining a size of a sheet set on the manual feed tray 111 according to the first embodiment is described.

FIG. 4 is a plan view for illustrating the manual feed tray 111. A bundle of sheets set on the manual feed tray 111 is clamped by the manual feed side regulation guides 212 and 213 so as to be prevented from being conveyed obliquely during conveyance by the pickup roller 113. Further, when sheets having different main scanning lengths are set, the manual feed side regulation guides 212 and 213 slide in the directions of the arrows 215 and 216. With this, oblique movement of the sheets is prevented. Further, the manual feed side regulation guides 212 and 213 are coupled to a sheet width sensor 217 through a link (not shown), and a value corresponding to a position of the manual feed side regulation guide 212 is input to the CPU 301. The sheet width sensor 217 is configured to detect a length of a sheet in a width direction orthogonal to the conveying direction of the sheet (hereinafter referred to as sheet width).

The CPU 301 performs detection of a sheet width in the width direction based on the input value. Further, the CPU 301 detects whether or not the first sensor 218 is shaded by the first detection flag 412 to thereby detect a sheet length of a sheet set on the manual feed tray 111. Similarly, the CPU 301 detects whether or not the second sensor 219 is shaded by the second detection flag 413 to thereby detect a sheet length of a sheet set on the manual feed tray 111.

In FIG. 5, there is shown a relationship between an output value of the sheet width sensor 217, which may vary in accordance with the movement of the manual feed side regulation guides 212 and 213, and a sheet width which is actually detected. Specifically, the sheet width sensor 217 is a sensor configured to output a 10-bit value, and outputs output values of from 0 to 0x400 substantially proportional to the sheet widths.

In FIG. 5, the output value 0x320 of the sheet width sensor 217 indicates 210 mm which is an A4R width. Similarly, the output value 0x384 indicates 257 mm which is a B4R width, and the output value 0x3D4 indicates 297 mm which is an A4 width.

The CPU 301 specifies the sheet size in accordance with an output value of the sheet width sensor 217 and outputs from the first sensor 218 and the second sensor 219. A data table which is referred by the CPU 301 to specify the sheet size is shown in FIG. 6.

As shown in FIG. 6, when it is provided that a manually fed sheet presence/absence sensor 214 being in an ON state, the first sensor 218 being in an OFF state, the second sensor 219 being in an OFF state, and an output value of the sheet width sensor 217 being 0x320±0x010, the size of the sheet is specified as an A5 size. An output value of the sheet width sensor 217 corresponding to the A5 size is 0x320. In this embodiment, when it is provided that the detection error of the sheet width sensor being 0x010, and the output value of the sheet width sensor 217 being within the range of 0x320±0x010, the size of the sheet is the A5 size.

Similarly, when it is provided that the manually fed sheet presence/absence sensor 214 being in an ON state, the first sensor 218 being in an ON state, the second sensor 219 being in an OFF state, and the output value of the sheet width sensor 217 being 0x320±0x010, the size of the sheet is specified as an A4R size. In such a manner, even when the output value of the sheet width sensor 217 is the same, the sheet size can be identified based on the difference in output of the first sensor 218 or the second sensor 219.

When the size of the sheet is the B5 size, the outputs of the first sensor 218 and the second sensor 219 are the same as those of the case where the size of the sheet is the A5 size. However, the output value of the sheet width sensor 217 is 0x384±0x010, and hence the sheet size can be determined based on the difference in the output value of the sheet width sensor 217.

<Description of UI>

Figure 7A:
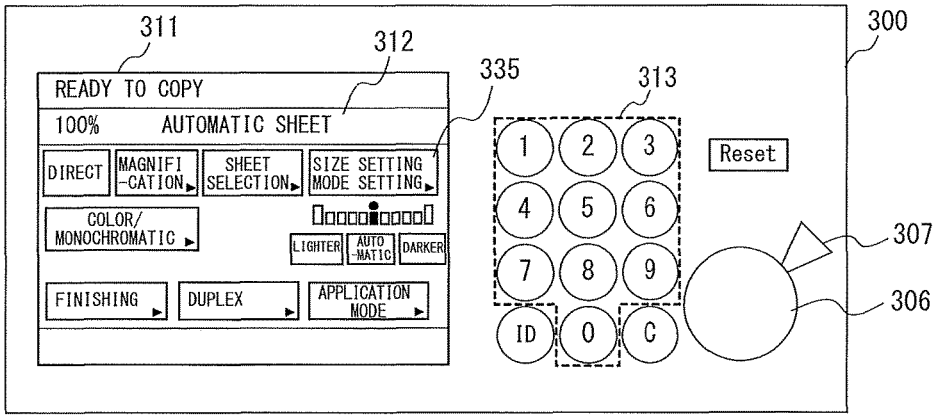
FIG. 7A, FIG. 7B, FIG. 7C, and FIG. 7D are explanatory views for illustrating a user interface.

FIG. 7A to FIG. 7D are explanatory views of the UI screen. FIG. 7A is an explanatory view for illustrating a screen of the UI 330 according to the first embodiment. On the UI 330, there are arranged a start key 306 for starting the copying operation, a stop key 307 for stopping the copying operation, numerical keys 313 for performing setting of the number of prints, and other keys. Further, there is also arranged a display portion 311 having a touch panel formed on a surface portion thereof, and soft keys can be created on the screen. On a sheet size display portion 312, copy setting is displayed. In this example, magnification is set to be 100% (same size), and sheet selection is set to be "AUTOMATIC SHEET". Further, the CPU 301 executes a printing preparation operation control in response to operation to the numerical keys 313 for performing setting of the number of sheets.

Figure 7B:
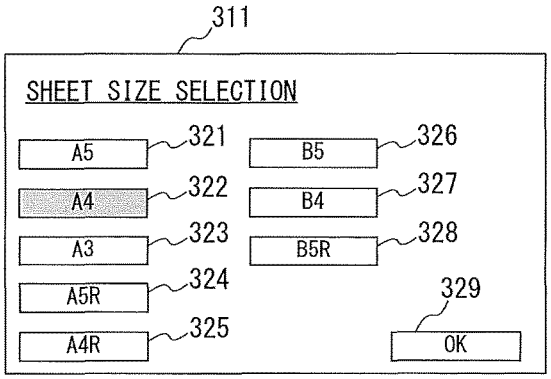

In FIG. 7B, a sheet size selection screen is illustrated which is displayed on the display portion 311 when the sheet P is set on the manual feed tray 111 under a state in which the fixed size mode is disabled. Under a state in which the fixed size mode is enabled, the size of the sheet to be used is set in advance by a user, and hence the sheet size selection screen is not displayed. Details of the fixed size mode are described later.

On the display portion 311, there are arranged an A5 button 321, an A4 button 322, an A3 button 323, an A5R button 324, an A4R button 325, a B5 button 326, a B4 button 327, and a B5R button 328. When an OK button 329 is pressed under a state in which any one of the buttons is selected, the sheet size is settled, and data representing the settled sheet size is stored in the RAM 303. After the sheet size is settled, when the CPU 301 determines that no sheet is present on the manual feed tray 111 based on the sheet sensor 115, the sheet size is unsettled, and the result is also stored in the RAM 303. After that, when the sheet P is set on the manual feed tray 111, the sheet size selection screen is displayed again. The printing operation cannot be started until the sheet size is settled.

Figure 7C:
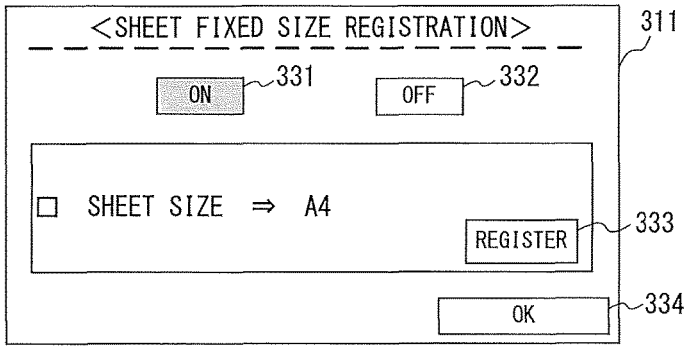
Figure 7D:
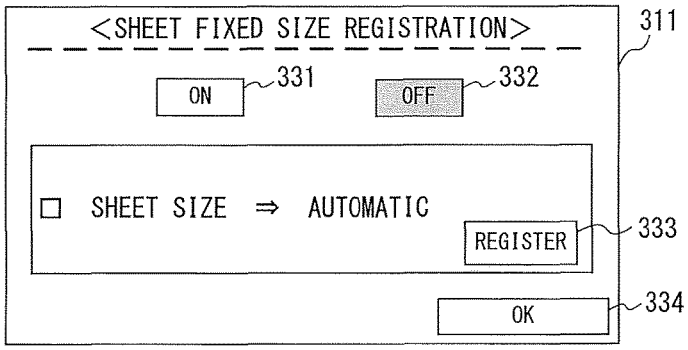

FIG. 7C and FIG. 7D are setting screens for the fixed size mode. When a fixed size mode setting button 335 arranged on the display portion 311 of FIG. 7A is pressed, shifting to the fixed size mode setting screen is performed.

When the size of the sheet to be used is set through the fixed size mode in advance, a user does not need to perform sheet size setting through the display portion 311 each time a user sets the sheet P on the manual feed tray 111. In the setting screen for the fixed size mode, there are arranged a mode enabling button 331, a mode disabling button 332, a sheet size registration button 333, and an OK button 334.

FIG. 7C is an illustration of a screen of the display portion 311 when the fixed size mode is enabled. When the sheet size registration button 333 is pressed under a state in which the mode enabling button 331 is selected, the sheet size can be set through the screen illustrated in FIG. 7B. When the OK button 329 is pressed under a state in which any one of the buttons 321 to 328 is selected, the screen illustrated in FIG. 7C is displayed. Next, when the OK button 334 is pressed, the fixed size mode is enabled with the selected sheet size. The CPU 301 stores information indicating that the fixed size mode is enabled in the RAM 303.

Now, the selected sheet size is described as the fixed size in the fixed size mode. For example, when the fixed size mode with the fixed size of A4 size is set, and a job which is designated to feed a sheet from the manual feed tray 111 is input, "A4" is displayed on the sheet size display portion 312 illustrated in FIG. 7A.

FIG. 7D is an illustration of a screen displayed when the fixed size mode is not enabled, that is, the fixed size mode is disabled. When a user presses the OK button 334 under a state in which the mode disabling button 332 is selected, information indicating that the fixed size mode is disabled is stored in the RAM 303. When a job which is designated to feed from the manual feed tray 111 is input under a state in which the fixed size mode is disabled, it is displayed on the sheet size display portion 312 that the sheet size can be set by a user ("AUTOMATIC").

<Raising and Lowering Operations of Pickup Roller>

FIG. 8A and FIG. 8B are explanatory views for illustrating the raising and lowering operations of the pickup roller 113 according to the first embodiment. FIG. 8C is a timing chart for illustrating the raising and lowering operations of the pickup roller 113 according to the first embodiment.

FIG. 8A is a plan view for illustrating the pickup roller 113 of a manual sheet-feeding unit and a sheet-feeding arm 160 configured to support the pickup roller 113. The pickup roller 113 is supported by the sheet-feeding arm 160 through a pickup roller shaft 161. A sheet-feeding arm shaft 162 is fixed to the sheet-feeding arm 160, and is configured such that driving of a raising and lowering motor 163 is transmitted thereto through a cam (not shown).

The raising and lowering operations of the pickup roller 113 are described with reference to a schematic explanatory view of the manual sheet-feeding unit illustrated in FIG. 8B. As illustrated in FIG. 8B, when the raising and lowering motor 163 is driven, the sheet-feeding arm shaft 162 is reciprocally rotated within a certain angular range through the above-mentioned cam. The sheet-feeding arm shaft 162 is fixed to the sheet-feeding arm 160, and the sheet-feeding arm 160 is raised and lowered through rotation about the sheet-feeding arm shaft 162 as a supporting point. The pickup roller 113 is raised and lowered in the directions of the arrow D1 in conjunction with raising and lowering of the sheet-feeding arm 160. When the pickup roller 113 is located at a pickup roller separation position which is a position most distant from the manual feed tray 111, a pickup roller HP sensor 167 is shaded by the sheet-feeding arm 160. The pickup roller HP sensor 167 is a sensor configured to detect that the pickup roller 113 is located at a home position. This home position is also a position of the pickup roller 113 when a sheet is not placed on the manual feed tray 111, and it is a position distant (raised) from the manual feed tray 111.

FIG. 8C is a timing chart for illustrating a relationship among driving of the raising and lowering motor 163, positions of the pickup roller 113, and the pickup roller HP sensor 167, with a horizontal axis representing time t.

The raising and lowering operations of the pickup roller 113 are described. As described above, when the size of a sheet is settled, the pickup roller 113 starts lowering from the separation position, which is a position distant from the manual feed tray 111, at a timing T1. At a timing T2 after elapse of a predetermined time period Ta (500 [ms] in this embodiment), the pickup roller 113 is moved to an abutment position which is closest to the manual feed tray 111. After that, the CPU 301 turns off driving of the raising and lowering motor 163 to hold the pickup roller 113 at the abutment position.

As described above, the pickup roller 113 is moved to the abutment position before the printing operation start instruction is received, and then the printing operation start instruction is received when the pickup roller 113 is located at the abutment position, thereby shortening a first copy output time (FCOT) by the predetermined time period Ta. Next, at a timing T3 after feeding of sheets of the number designated by a job is completed, the CPU 301 turns on driving of the raising and lowering motor 163, thereby causing the pickup roller 113 to start raising from the abutment position. At a timing T4 of detecting an ON edge of the pickup roller HP sensor 167, it is determined that the pickup roller 113 has been moved to the separation position, and then driving of the pickup roller raising and lowering motor 163 is turned off to hold the pickup roller 113 at the separation position in the same way.

In the first embodiment, when the CPU 301 detects that a sheet is present on the manual feed tray 111 under a state in which the fixed size mode is enabled, the CPU 301 determines whether or not the size designated by a user matches with a size detection result. When the designated size matches with the size detection result, the CPU 301 causes the pickup roller 113 to be moved to the abutment position. Accordingly, sheet feeding can be performed immediately in response to a printing start instruction. As a result, the FCOT is shortened by a time period necessary for the pickup roller 113 to be brought into abutment against the sheet as compared to the configuration in which the pickup roller 113 is lowered after receiving an instruction to start printing.

When the fixed size mode is enabled, the sheet size is settled in advance by a user through the UI 330. Therefore, under a state in which the fixed size mode is enabled, the CPU 301 causes the pickup roller 113 to be moved to the abutment position in response to the detection that a sheet having a size matched with a fixed size is present on the manual feed tray 111. The reason for this is described in detail.

When the pickup roller 113 is held in abutment against the sheet, the pickup roller 113 is pressed toward the tray side to some extent to feed a sheet from the manual feed tray 111. Even in such a case, a user can remove the sheet from the manual feed tray 111.

However, when the pickup roller 113 is located at the abutment position, it is difficult for a user to insert a sheet to a position between the manual feed tray 111 and the pickup roller 113. Therefore, when an initial position of the pickup roller 113 is set to the abutment position of the pickup roller 113 regardless of a state of the apparatus or presence of the sheet placed on the manual feed tray 111, usability may be deteriorated.

Further, under a state in which the fixed size mode is not enabled, it is assumed that a sheet to be used with the manual feed tray 111 is different every time. Therefore, when the manual feed tray 111 is to be used, it is necessary that a user set a sheet on the manual feed tray 111, adjust the manual feed side regulation guides 212 and 213 to a sheet width, and select through the operation unit a size of the sheet to be used. When a system is employed in which the pickup roller 113 is moved to the abutment position at the timing of detecting that a sheet is present, the pickup roller 113 is located at the abutment position while a user is setting the sheet on the manual feed tray 111. Thus, usability is deteriorated when a user adjusts the manual feed side regulation guides 212 and 213 to correctly set a sheet.

In contrast, under a state in which the fixed size mode is enabled, a size of a sheet to be used is settled in advance. Thus, it is highly probable that the sheet to be set on the manual feed tray 111 is the same every time. In other words, it can be considered that the positions of the manual feed side regulation guides 212 and 213 are often already adjusted to a width of the sheet to be set, and hence a user need not make adjustment over again.

Thus, even when the pickup roller 113 is moved to the abutment position after it is detected that a sheet of a designated size is present on the manual feed tray 111, it is less likely to cause a hindrance, such as requiring a user to set a sheet again. Therefore, usability under a state in which the fixed size mode is enabled can be maintained. From the description above, even when the pickup roller 113 is moved to the abutment position at the point of time when a user sets a sheet having a designated size on the manual feed tray 111, the FCOT can be shortened without deteriorating usability.

As described above, when the fixed size mode is enabled, a sheet to be set on the manual feed tray 111 has a designated size, and hence it is highly probable that the positions of the manual feed side regulation guides 212 and 213 are already adjusted to the width of the sheet to be set. Therefore, the pickup roller 113 may be moved to the abutment position based on the detection that a sheet is placed rather than on the condition that the size of the sheet placed on the manual feed tray 111 matches with the designated size.

<Flow of Detecting Sheet Placed on Manual Feed Tray 111>

Figure 9:
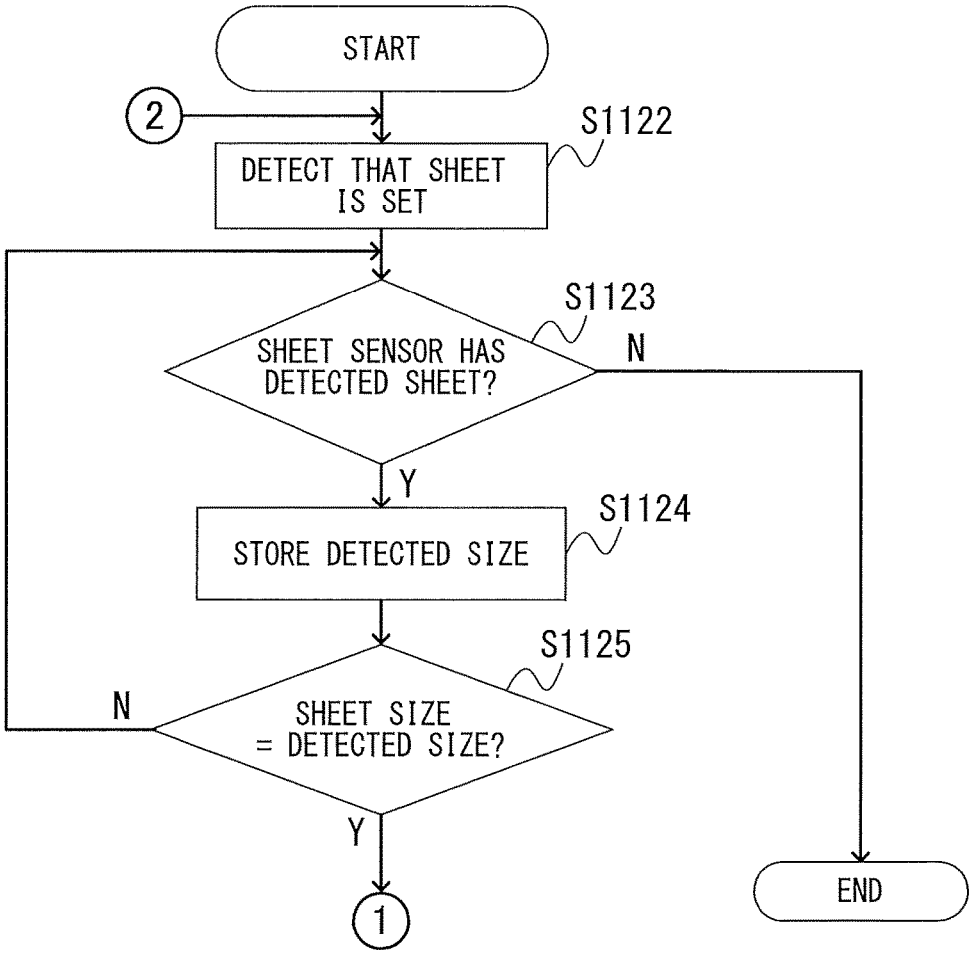
FIG. 9 is a flowchart for illustrating a control which is executed when a sheet is set on the manual feed tray.

FIG. 9 is a flowchart for illustrating a control to be executed by the CPU 301 after detection of a sheet set on the manual feed tray 111 when the fixed size mode is enabled.

When the fixed size mode is enabled, the sheet size has already been selected through the UI 330, and hence information related to the sheet size is stored in the RAM 303. As described with reference to FIG. 7, for example, when a user sets the A4 size in the fixed size mode, information indicating designation of the A4 size as the sheet size is stored in the RAM 303. This information indicating designation of the A4 size is maintained in the RAM 303 until the fixed size mode is disabled.

As illustrated in FIG. 9, the CPU 301 detects whether or not a sheet is set on the manual feed tray 111 (Step S1122). After that, the CPU 301 determines through the sheet sensor 115 whether or not the sheet is present on the manual feed tray 111 (Step S1123). When it is determined that no sheet is present (Step S1123: N), the CPU 301 determines that a sheet is removed, and the flow is terminated. When it is determined that a sheet is present (Step S1123: Y), the CPU 301 stores in the RAM 303 the above-mentioned size detection result on the manual feed tray 111 as the detected size (Step S1124).

After the detected size is settled, the CPU 301 determines whether or not the sheet size set by a user in the fixed size mode matches with the detected size (Step S1125). When the sizes do not match (Step S1125: N), processing of the CPU 301 returns to the Step S1123.

As one example, there is a case where a sheet having a size different from the set fixed size is erroneously set on the manual feed tray 111 by a user. In this case, a user needs to remove the sheet from the manual feed tray 111 to replace it with a sheet having a correct size on the manual feed tray 111. At this time, when the pickup roller 113 is located at the abutment position, usability during the replacement operation may be deteriorated as described above. Thus, at this point of time, the control of causing the pickup roller 113 to be moved to the abutment position is not performed.

Meanwhile, when the detected size matches with the fixed size (Step S1125: Y), it can be considered that the operation of the manual feed side regulation guides 212 and 213 by a user is completed. In other words, the operation by a user is not bothered by the movement of the pickup roller 113 to the abutment position. Thus, the CPU 301 executes a pickup roller lowering sub-flow illustrated in FIG. 10 described later to cause the pickup roller 113 to be moved to the position held in abutment against the manual feed tray 111.

<Pickup Roller Lowering Sub-Flow>

Figure 10:
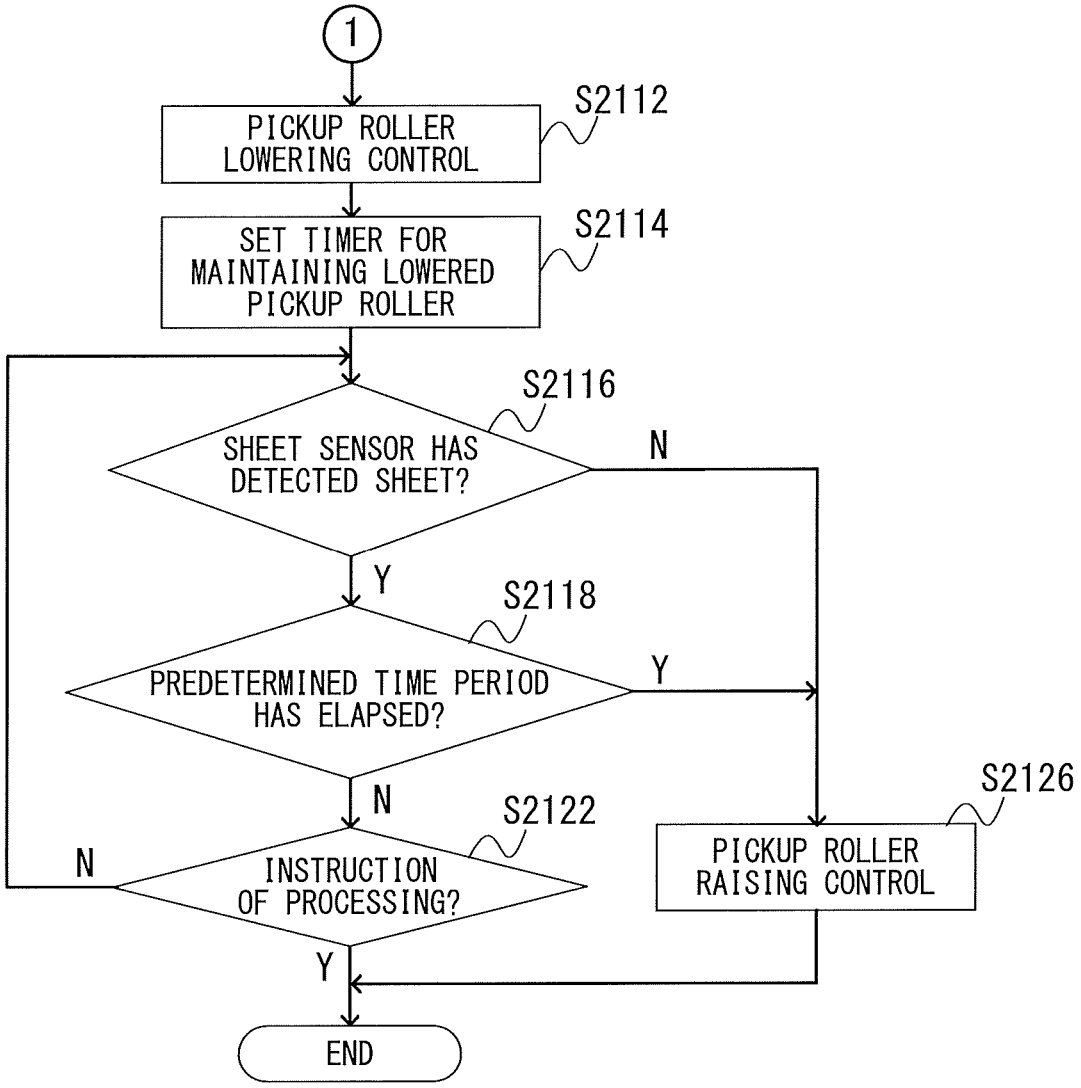
FIG. 10 is a flowchart for illustrating the pickup roller lowering sub-flow.

FIG. 10 is a flowchart for illustrating the pickup roller lowering sub-flow. When it is determined in the Step S1125 of FIG. 9 that the detected size and the sheet size are equal (Step S1125: Y), the CPU 301 executes a control of lowering the pickup roller 113 prior to receiving the printing start instruction (Step S2112). Specifically, as illustrated in FIG. 8C, the raising and lowering motor 163 is driven for the time period Ta (Step S2112).

Next, in order to prevent the lowered pickup roller 113 from being maintained at the abutment position for a long time, the timer 291 is set so that elapse of a predetermined time period can be determined (Step S2114). In this example, the predetermined time period is set as 30 seconds.

The CPU 301 determines through the sheet sensor 115 whether or not a sheet is present on the manual feed tray 111 (Step S2116). When a sheet is not detected by the sheet sensor 115 (Step S2116: N), the CPU 301 updates the sheet size information stored in the RAM 303 to "size unsettled", and causes the pickup roller 113 to be raised and moved to the separation position (Step S2126).

With this, the pickup roller 113 is separated from the manual feed tray 111, and hence a user can set a sheet on the manual feed tray 111. Specifically, the CPU 301 drives the raising and lowering motor 163 until the ON edge of the pickup roller HP sensor 167 is detected, and then terminates the processing.

Meanwhile, when the sheet sensor 115 detects a sheet (Step S2116: Y), it is determined through the timer 291 whether or not the predetermined time period has elapsed (Step S2118). When the predetermined time period has elapsed (Step S2118: Y), the CPU 301 executes the processing of the above-mentioned Step S2126 to cause the pickup roller 113 to be moved to the separation position, and then terminates the processing.

When the pickup roller 113 is left for a long time under a state of being held in abutment against a sheet, a roller trace may remain on the uppermost sheet stacked on the manual feed tray 111. Accordingly, in this embodiment, elapse of the predetermined time period is detected to thereby detect that sheet feeding is not performed even after elapse of the predetermined time period. In this case, printing is unlikely to be started, and hence the CPU 301 causes the pickup roller 113 to be moved to the separation position.

When the predetermined time period has not elapsed (Step S2118: N), the CPU 301 determines whether or not printing processing is started in accordance with the printing start instruction (Step S2122). When the printing processing is not started (Step S2122: N), the CPU 301 executes the processing of Step S2116. When the printing processing is started (Step S2122: Y), the CPU 301 terminates the processing.

<Control Flow Executed Upon Powering on or Recovering from Power-Saving Mode>

Figure 11:
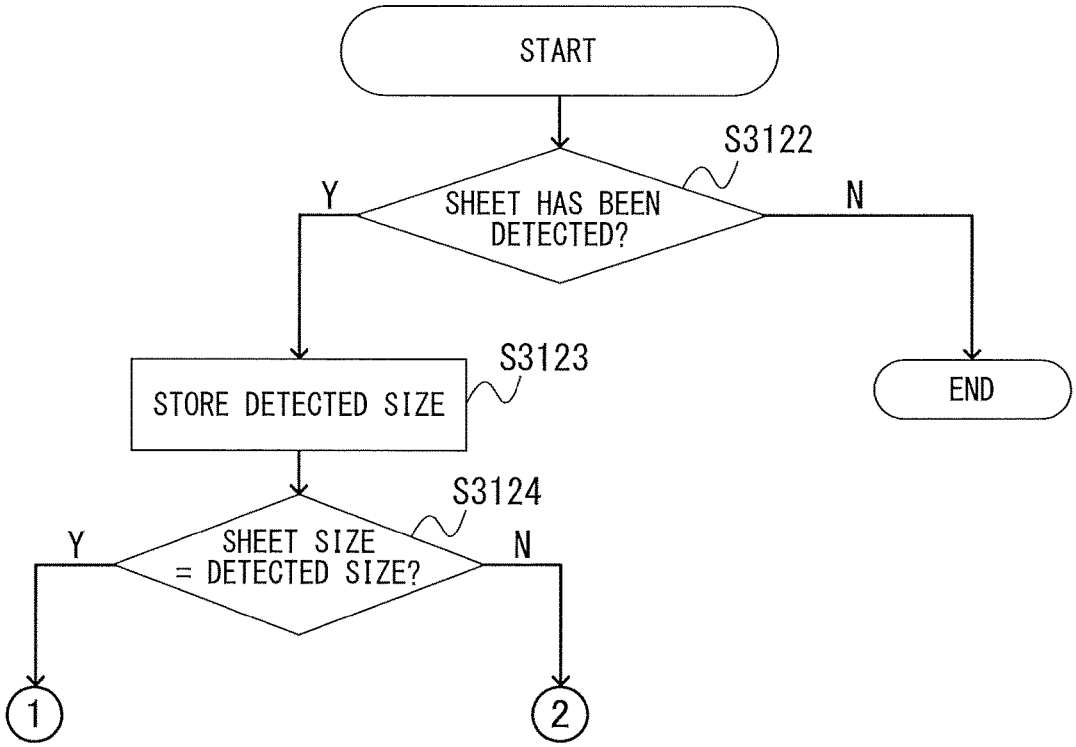

FIG. 11 is a flowchart for illustrating a control executed by the CPU 301. This control is executed when the image forming apparatus 10 according to the first embodiment is powered on or recovered from a power-saving mode, while the fixed size mode is enabled.

The CPU 301 determines through the sheet sensor 115 whether or not a sheet is placed on the manual feed tray 111 (Step S3122). When a sheet is not detected (Step S3122: N), the CPU 301 terminates the processing. When a sheet is detected (Step S3122: Y), the CPU 301 stores in the RAM 303 the size detection result on the manual feed tray 111 as the detected size (Step S3123).

After the detected size is settled, the CPU 301 determines whether or not the sheet size set by a user in the fixed size mode matches with the detected size (Step S3124). When the sizes do not match (Step S3124: N), the CPU 301 executes processing of detecting whether or not a sheet is set on the manual feed tray 111 described with reference to FIG. 9 (Step S1122). When the detection result matches (Step S3124: Y), the CPU 301 executes the pickup roller lowering control processing described with reference to FIG. 10 (Step S2112). Through the control described above, even when printing processing or the like is required to be started immediately after the image forming apparatus 10 is powered on or recovered from the power-saving mode, the FCOT can be shortened while maintaining usability.

<Control Flow Executed at the Time of Starting Print Job>

Figure 12:
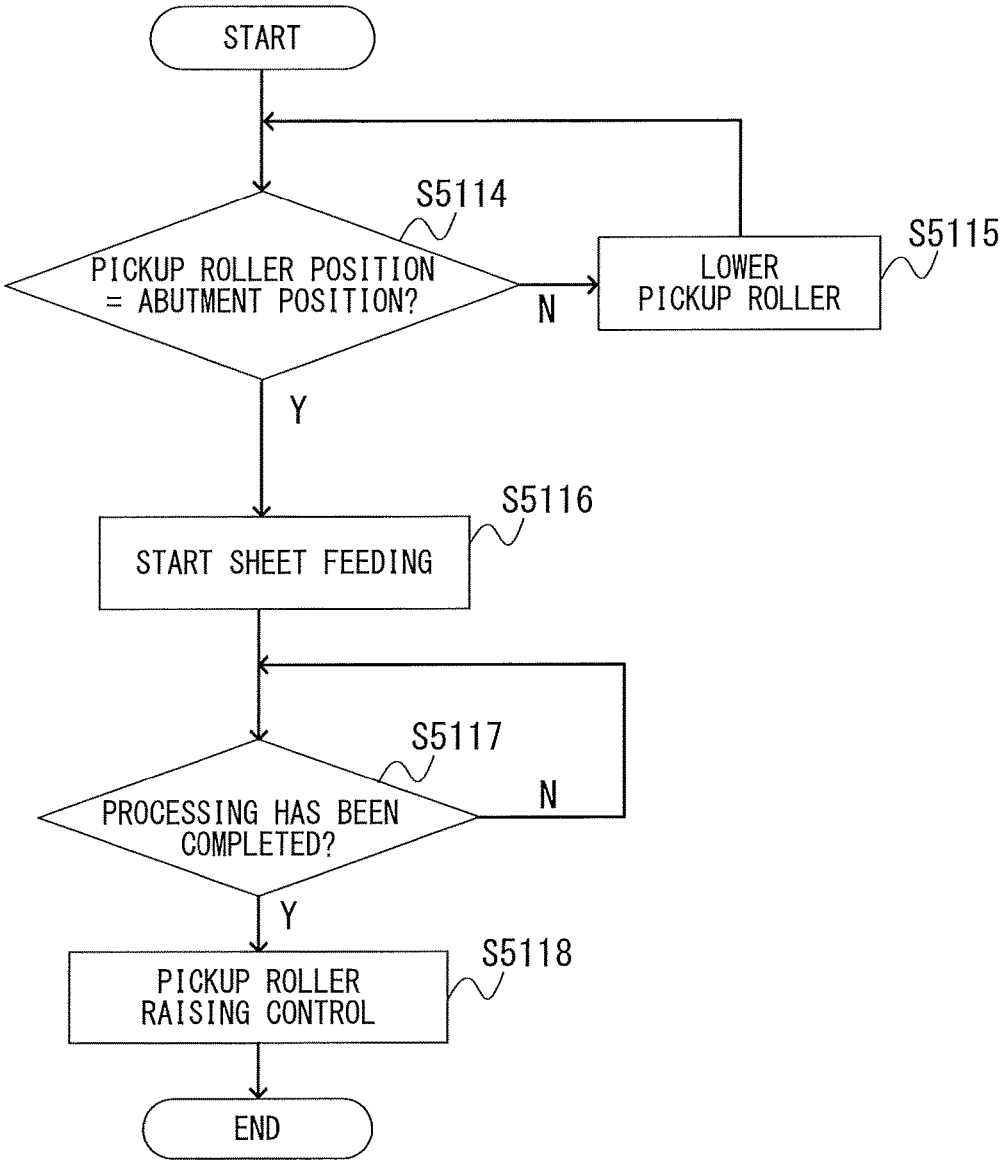
FIG. 12 is a flowchart for illustrating a control which is executed when a print job is started.

FIG. 12 is a flowchart for illustrating a control which is executed at the time of starting printing processing in the image forming apparatus 10.

After the printing processing start instruction is received, the CPU 301 determines whether or not the pickup roller 113 is located at the abutment position (Step S5114). When the pickup roller 113 is located at the abutment position (Step S5114: Y), sheet feeding is started (Step S5116). When the pickup roller 113 is not located at the abutment position (Step S5114: N), the CPU 301 causes the pickup roller 113 to be lowered and moved to the abutment position (Step S5115), and executes the processing of Step S5114 again. After that, when the pickup roller 113 is lowered to the abutment position, the determined result Y is attained in the processing of Step S5114, and then sheet feeding is started (Step S5116).

After sheet feeding is started, the CPU 301 determines whether or not printing processing has been completed (Step S5117). When the printing processing has not been completed (Step S5117: N), the processing of Step S5117 is executed again. When the printing processing has been completed (Step S5117: Y), the CPU 301 executes a control of causing the pickup roller 113 to be moved to the separation position (Step S5118) and terminates the processing.

With regard to Step S5114 of FIG. 12, there is a case where the fixed size mode is enabled as illustrated in Step S3122 to Step 3124 of FIG. 11. In this case, the pickup roller 113 is moved to the abutment position at a timing of the detection in FIG. 11 that a sheet is present on the manual feed tray 111 (Step S3122: Y).

Generally, a user gives a printing processing start instruction after setting a sheet on the manual feed tray 111. Therefore, in FIG. 12, the detection result Y is attained in the processing of Step S5114 executed after starting the printing processing. However, as described with reference to FIG. 10 for example, there is also a case where the printing processing is not performed even after elapse of a predetermined time period since a sheet is set by a user on the manual feed tray 111 (Step S2118: Y).

In this case, as illustrated in FIG. 10, the CPU 301 causes the pickup roller 113 to be raised and moved to the separation position (Step S2126). In such a case, the determined result N is attained in Step S5114 of FIG. 12, and the processing of Step S5115 is executed.

Meanwhile, in this embodiment, the control of causing the pickup roller 113 to be moved to the abutment position prior to the printing processing is not executed under a state in which the fixed size mode is disabled. Thus, in this case, the determined result N is attained in Step S5114 of FIG. 12 (Step S5114: N), and the CPU 301 executes the control of causing the pickup roller 113 to be moved to the abutment position in Step S5115.

As described above, according to the present invention, when the fixed size mode is enabled, and it is detected that a sheet is placed on the manual feed tray 111, the pickup roller 113 has already been moved to the abutment position. Accordingly, with the pickup roller held in abutment against the sheet, sheet feeding can be started promptly after starting printing while maintaining usability at the time of enabling the fixed size mode. Thus, the time having been required for the pickup roller to be brought into abutment against the sheet may be shortened, and hence the first copy time can be shortened.

The present invention is not limited to the above-mentioned embodiment, and can be practiced in various modes. For example, the mechanical configuration and the raising and lowering conditions of the raising and lowering motor 163, the pickup roller 113, and the pickup roller HP sensor 167 illustrated in the first embodiment are mere examples.

Further, in the first embodiment, the configuration of fixing the manual feed tray 111 and raising and lowering the pickup roller 113 is employed so that the pickup roller 113 and the sheet are brought into abutment against each other or separated from each other. However, the configuration of fixing the pickup roller 113 and raising and lowering the manual feed tray 111, or the configuration of allowing both the pickup roller 113 and the manual feed tray 111 to be raised and lowered concurrently may also be employed. In other words, it is only necessary that at least one of the pickup roller 113 and the manual feed tray 111 be moved in a direction of allowing the pickup roller 113 and the manual feed tray 111 to approach to each other or separate from each other.

As described above, according to the present invention, when a size of a sheet to be fed is designated by a user in advance, and it is determined that a sheet is placed on the manual feed tray, at least one of the sheet-feeding unit and the manual feed tray is moved. This movement is performed so that the sheet-feeding unit and the manual feed tray are located at positions of enabling the sheet-feeding unit to feed a placed sheet. Thus, a delay time until sheet feeding is enabled can be shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-174950, filed Sep. 4, 2015 which is hereby incorporated by reference herein in its entirety.

What is claimed is:

1. An image forming apparatus, comprising:

a manual feed tray on which a sheet to be subjected to image formation is placed;

a sheet detector configured to detect whether the sheet is placed on the manual feed tray or not;

a fixed size setting unit configured to set a size of the sheet to be used with the manual feed tray in advance even if the sheet detector detects that the sheet is not placed on the manual feed tray;

a size detector configured to detect a size of a sheet placed on the manual feed tray, the size detector comprising a first sensor configured to detect a length of a sheet placed on the manual feed tray in a conveying direction and a second sensor configured to detect a length of a sheet placed on the manual feed tray in a direction intersecting with the conveying direction;

a sheet-feeding unit configured to feed the sheet placed on the manual feed tray; and a controller, wherein, in a case where the size of the sheet is set by the fixed size setting unit, when the sheet detector determines that the sheet is placed on the manual feed tray and a detected size that is determined in accordance with detection results of the first sensor and the second sensor of the size detector and a fixed size that is set by the fixed size setting unit are matched, the controller causes at least one of the sheet-feeding unit and the manual feed tray to start movement so that the sheet-feeding unit and the sheet on the manual feed tray are in contact with each other.

2. The image forming apparatus according to claim 1, wherein the controller causes the at least one of the sheet-feeding unit and the manual feed tray to be moved to a position of enabling the sheet-feeding unit to feed the placed sheet.

3. The image forming apparatus according to claim 1, wherein the controller causes the movement of the sheet-feeding unit to be prevented from being started when the detected size and the fixed size do not match.

4. The image forming apparatus according to claim 1, wherein, when the sheet detector determines that the sheet is not placed on the manual feed tray during a period after starting of the movement and before starting of image forming, the controller causes the at least one of the sheet-feeding unit and the manual feed tray to be moved in the direction of separating the sheet-feeding unit and the manual feed tray.

5. The image forming apparatus according to claim 1, further comprising a mode setting unit configured to determine whether to enable setting of the fixed size setting unit or not.

6. The image forming apparatus according to claim 5, further comprising a manual size setting unit configured to set a size for a sheet on the manual feed tray, wherein, in a case where the setting of the fixed size setting unit is not enabled by the mode setting unit, when the sheet detector determines that the sheet is placed on the manual feed tray, the controller enables the manual size setting unit to set the size of the sheet, and wherein, in a case where the setting of the fixed size setting unit is enabled by the mode setting unit, when the sheet detector determines that the sheet is placed on the manual feed tray, the controller prevents the manual size setting unit from setting the size of the sheet.

7. The image forming apparatus according to claim 1, wherein the sheet-feeding unit is movable, and wherein the controller causes the sheet-feeding unit to be moved toward the manual feed tray to enable the sheet-feeding unit to feed the placed sheet.

8. The image forming apparatus according to claim 1, wherein the manual feed tray is movable, and wherein the controller causes the manual feed tray to be moved toward the sheet-feeding unit to enable the sheet-feeding unit to feed the placed sheet.

9. An image forming method to be performed by an image forming apparatus, the image forming apparatus comprising a manual feed tray on which a sheet to be subjected to image formation is placed, a size detector configured to detect a size of a sheet placed on the manual feed tray, the size detector comprising a first sensor configured to detect a length of a sheet placed on the manual feed tray in a conveying direction and a second sensor configured to detect a length of a sheet placed on the manual feed tray in a direction intersecting with the conveying direction, and a sheet-feeding unit configured to feed the sheet placed on the manual feed tray, the image forming method comprising:

detecting whether or not the sheet is placed on the manual feed tray;

setting a fixed size of the sheet to be used with the manual feed tray in advance even if the sheet detector detects that the sheet is not placed on the manual feed tray; and in a case where the fixed size is set in advance, when the sheet is placed on the manual feed tray and a detected size that is determined in accordance with detection results of the first sensor and the second sensor of the size detector and a fixed size that is set by the fixed size setting unit are matched, starting movement of at least one of the sheet-feeding unit and the manual feed tray so that the sheet-feeding unit and the sheet on the manual feed tray are in contact with each other.

10. An image forming apparatus, comprising:

a manual feed tray on which a sheet to be subjected to image formation is placed;

a determining unit configured to determine whether the sheet is placed on the manual feed tray or not;

a sheet-feeding unit configured to feed the sheet placed on the manual feed tray; and a controller, wherein, in a case where a size of a sheet to be placed on the manual feed tray is designated by a user before the sheet is placed on the manual feed tray and the determining unit determines that the sheet is placed on the manual feed tray, the controller causes at least one of the sheet-feeding unit and the manual feed tray to start movement so that the sheet-feeding unit and the manual feed tray approach, and wherein, when sheet feeding is not performed even after elapse of a predetermined time period from the movement, the controller causes the at least one of the sheet-feeding unit and the manual feed tray to be moved in a direction of separating the sheet-feeding unit and the manual feed tray.

11. An image forming apparatus according to claim 1, wherein, when sheet feeding is not performed even after elapse of a predetermined time period from the movement, the controller causes the at least one of the sheet-feeding unit and the manual feed tray to be moved in a direction of separating the sheet-feeding unit and the manual feed tray.

12. An image forming method according to claim 9, wherein, when sheet feeding is not performed even after elapse of a predetermined time period from the movement, the at least one of the sheet-feeding unit and the manual feed tray are caused to be moved in a direction of separating the sheet-feeding unit and the manual feed tray.

* * * * *